US007757977B2

(12) United States Patent
Hindström

(10) Patent No.: US 7,757,977 B2
(45) Date of Patent: Jul. 20, 2010

(54) METHOD FOR COMMINUTION OF MATERIAL

(75) Inventor: Sami Hindström, Pusula (FI)

(73) Assignee: Outotec Oyj, Espoo (FI)

( * ) Notice: Subject to any disclaimer, the term of this patent is extended or adjusted under 35 U.S.C. 154(b) by 366 days.

(21) Appl. No.: 11/576,329

(22) PCT Filed: Oct. 4, 2005

(86) PCT No.: PCT/FI2005/000421

§ 371 (c)(1),
(2), (4) Date: Mar. 29, 2007

(87) PCT Pub. No.: WO2006/037842

PCT Pub. Date: Apr. 13, 2006

(65) Prior Publication Data

US 2007/0257139 A1 Nov. 8, 2007

(30) Foreign Application Priority Data

Oct. 4, 2004 (FI) ..... 20041284

(51) Int. Cl.
*B02C 11/08* (2006.01)
*B02C 21/00* (2006.01)

(52) U.S. Cl. ..... 241/23; 241/1; 241/24.25

(58) Field of Classification Search ..... 241/1, 241/23, 24.1, 24.25, 30
See application file for complete search history.

(56) References Cited

U.S. PATENT DOCUMENTS

| | | | | |
|---|---|---|---|---|
| 3,261,959 | A | 7/1966 | Connell et al | |
| 3,759,617 | A * | 9/1973 | Barringer | 356/36 |
| 6,248,985 | B1 * | 6/2001 | Tomasello | 219/679 |
| 2003/0029944 | A1 * | 2/2003 | Flinn et al. | 241/1 |
| 2005/0236403 | A1 | 10/2005 | Kingman | |

FOREIGN PATENT DOCUMENTS

| | | |
|---|---|---|
| SU | 2876916 | 1/1980 |
| SU | 3919316 | 5/1985 |
| WO | 9218249 | 10/1992 |

* cited by examiner

*Primary Examiner*—Bena Miller
(74) *Attorney, Agent, or Firm*—Chernoff, Vilhauer, McClung & Stenzel

(57) ABSTRACT

The invention relates to a method for comminution of material in a grinding mill, in which method the ground material from the mill is classified by means of particle sizes. After the classification of the ground material at least the part of the material having a particle size greater than the desired predetermined particle size is targeted to an electromagnetic energy treatment in at least one stage.

23 Claims, 2 Drawing Sheets

METHOD FOR COMMINUTION OF MATERIAL

Figure 1:
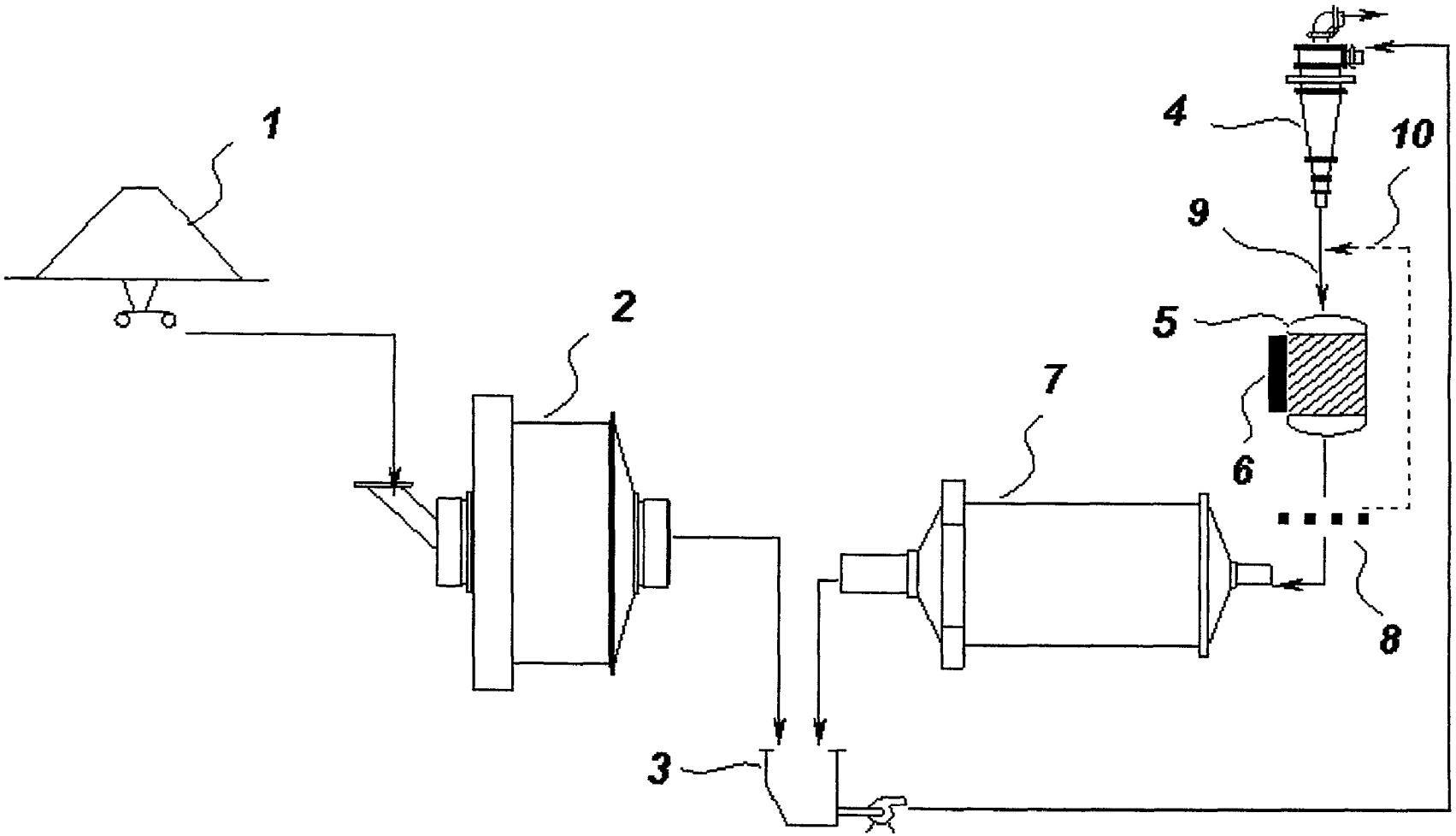

This is a national stage application filed under 35 USC 371 based on International Application No. PCT/FI2005/000421 filed Oct. 4, 2005, and claims priority under 35 USC 119 of Finnish Patent Application No. 20041284 filed Oct. 4, 2004.

This invention relates to a method for comminution of material, such as ore, concentrate or mineral slurry, in which method electromagnetic energy is used in comminution for at least one fraction of the material to be comminuted.

Energy of high field strength electromagnetic energy, such as microwaves assists comminution process by generating defaults and cracks to ore prior comminution. Based on the studies by S. Kingman et al., Application of High Electric Field Strength Microwave Energy for Processing Ores and Minerals, Proceedings in XXII International Mineral Processing Congress, Cape Town, 29 Sep.-3 Oct. 2003, the mechanism of high field strength electromagnetic energy induced failure is the development of tangential stresses at the grain boundaries. In this study, ores of varying mineralogy were treated in both multimode and single mode microwave cavities.

Multimode microwave with homogeneous loads provides heating even in the case of regular geometries. However, the load inside a multimode cavity significantly influences the electric field distribution within the cavity. Thus, applying multimode microwaves on multiphase irregular particles, such as ore, causes some part of the load heat very quickly and others to receive little expose. Therefore, the efficiency of multimode microwave is often poor.

In single mode microwave applications, the superposition of the reflected and incident waves gives rise to a standing wave pattern that is very well defined in space and usually localised in a small volume. The precise knowledge of electromagnetic field configurations enables the dielectric material to be placed in the position of maximum field strength allowing maximum-heating rates to be achieved at all times. Thus, single mode microwave treatment of ore enables reductions in ore strength more than 50% in shorter induction time (time between 0.1 s and 1 s) compared to multimode treatment. The short residence time allows pass through the cavity a significant tonnage of material. The treatment also provides more even quality compared to the multimode treatment.

The maximum diameter of the single mode microwave chamber is limited by electromagnetic considerations. The conventional industrial microwave heating systems utilizing a frequency of 915 MHz allow to built at maximum 27 cm diameter chamber to treat the material. The main problem of the current single mode microwave assisted comminution application lies on the size of the microwave chamber. An uneven material easily blocks a chamber with a diameter of 27 cm. Thus, it is in practice not feasible to pre-treat the ore by microwave right after primary crushing/weakening prior comminution or other process without further mechanical weakening, conditioning and/or screening prior microwave treatment. In practice, two-three stages crushing including screening are needed for a reasonably reliable operation. For example, the WO patent application 03/083146 notes the necessity of mechanical condition/size of the ore before microwave treatment. In addition of exceeded investment and operation costs due to the additional apparatuses, the microwave treatment is the bottleneck of the overall process. The microwave assisted comminution process of the WO patent application 03/083146 handles also a single mode microwave treatment of multiphase materials as a pre-treatment process before comminution. The time for the preferable microwave treatment is described to be not more than 0.5 s. In this case the typical power density is described to be about $10^{12}$ watts per cubic meter or above, or better still $10^{15}$ to $10^{16}$ $Wm^{-3}$. Further, the WO patent application 03/083146 concentrates on treatment of ores and an example for multiphase materials are given as metal oxides or sulphides and silicates.

The WO patent application 03/102250 describes a single mode microwave treatment of ores. The microwave treatment is placed after the primary crusher before the comminution or leaching step and the whole amount of the ore is treated. This WO reference concentrates on treatment of ores.

The object of the present invention is to eliminate some drawbacks of the prior art and to achieve a more efficient method of comminution of material, such as ore, concentrate or mineral slurry, by treating at least one fraction of the material in at least one stage of a grinding circuit with electromagnetic energy, such as microwaves. The essential features of the invention are enlisted in the appended claims.

A material to be treated in a method of the invention is first ground in a grinding mill with a grinding media. The ground particles are then fed into a classifier in order to classify the particles into classes having different particle sizes. The classifier can be for instance a cyclone, a sieve or the like which is used to classify material by means of particle sizes. The coarse particles from the classifier having a particle size greater than the predetermined particle size desired in the further processing of the particles is in accordance with the invention fed into a chamber wherein the coarse particles are targeted into radiation with electromagnetic energy, such as microwaves. The treatment with electromagnetic energy can be repeated once or more for the particles, if after the first treatment the particle size is still greater than the desired particle size. After the desired treatment with electromagnetic energy the particles are returned back to comminution in a mill. The mill can be the same mill wherein the preliminary grinding has been carried out or the mill can be a mill separated from the preliminary grinding.

In a preferred embodiment of the invention the classifier for the ground particles is a cyclone wherefrom the coarse particles to be treated with electromagnetic energy are removed as an underflow through a conduit connected into the lower part of the cyclone. The coarse particles are then conducted advantageously to the top part of a chamber, which is provided with or connected to at least one source of electromagnetic energy. The coarse particles to be radiated are flowing through the chamber in essentially vertical direction so that the radiated particles are removed from the chamber, from the lower part of the chamber. However, any flow direction between vertical and horizontal and even the essentially horizontal direction is practical for the material to be treated by electromagnetic energy in accordance with invention. The radiated particles are then fed into a grinding mill for further comminution. After grinding the particles are further classified and in a case if there are still particles which particle size is greater than the desired particle size those particles are conducted back to the radiation treatment with electromagnetic energy, such as microwaves. The treatment with electromagnetic energy can be repeated twice or more, if necessary.

The treatment of the particles by radiating with electromagnetic energy, such as microwaves, in accordance with the invention is carried out by using a single mode, a multi mode or a pulsated mode radiation. The radiation is caused by at least one radiation source. In a case of one source the source will use a single mode, a multi mode or a pulsated radiation. If two or more radiation sources are used the sources are arranged to each other so that preferably the distance between two sources is essentially equal. The sources can be arranged to operate so that radiations of different modes are utilized.

The preferred frequencies of the electromagnetic energy used in the invention are 433 MHz, 896 MHz, 915 MHz or 2.5 GHz in which circumstances microwaves are used. The operating time under the influence of the electromagnetic energy is between 0.01 and 1.0 s, preferably between 0.05 and 0.5 s. The energy intensity for different materials is between $10^7$ and $10^9$ W/m$^3$, preferably between $6\times10^7$ and $8\times10^8$ W/m$^3$.

The materials to be treated in the method of the invention can be oxidic, sulfidic or mixed ores or concentrates. In addition to ores or concentrates, the materials can also be mineral slurries with moisture content up to 35%.

When treating in accordance with the invention only that part of material, which was not comminuted in the preliminary grinding into the desired particle size, it is possible that the device of the prior art with the dimensional limitation can be attached to the classifier. The additional energy caused by the electromagnetic treatment will be applied to the hardest fraction only, because the particles, which are not comminuted in the preliminary grinding, are harder than those particles, which are ground in the preliminary grinding. By targeting the hardest component on the ore the added energy will give best response on lowering the apparent hardness of the ore and allowing more efficient comminution in means of higher throughput at targeted comminution level with lower total energy consumption. The new approach leaves also more options to select the crushing and primary stage comminution before applying the external mineral targeted/specific energy to enhance the comminution efficiency.

The invention is described in more details in the following drawings wherein

Figure 2:
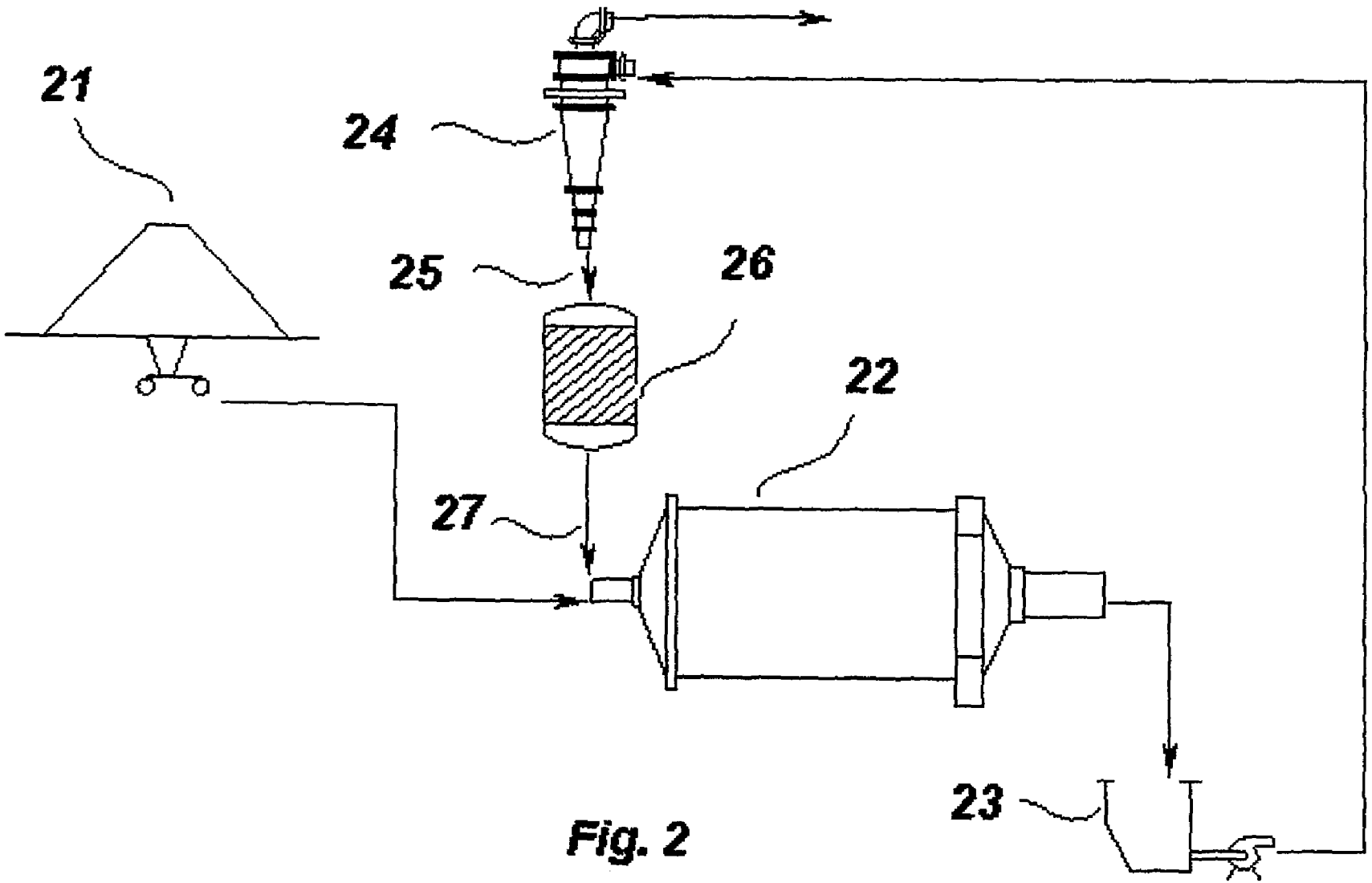

FIG. 1 illustrates one preferred embodiment of the invention as a schematic flow-sheet, and FIG. 2 illustrates another preferred embodiment of the invention as a schematic flow sheet.

According the FIG. 1 a sulfidic ore 1 to be comminuted is mixed with water and fed into a grinding mill 2 for comminution as wet grinding. The ground material is discharged from the mill 2 into a pin 3 and further fed into a cyclone 4 for classification. The part of the material, which is coming out of the cyclone 4 as an underflow 9 from the lower part of the cyclone 4 is conveyed into a chamber 5 for the treatment with electromagnetic energy. The chamber 5 is provided with at least one source 6 for microwave with the frequency of 2.45 GHz. The chamber 5 is tube-like in shape and the wall of the chamber 5 is provided with apertures through which the microwave radiation from the source 6 is focused into the interior of the chamber 5. The material conveying through the interior of the chamber 5 is flowing essentially vertical from the upper part of the chamber 5 to the lower part of the chamber 5. The chamber 5 is so measured that the delay time for the material being under the influence of the microwave radiation is 0.1 s.

The material flowing out of the chamber 5 is further fed in a secondary grinding mill 7 in which the material is comminuted and after grinding conveyed for further processing through the pin 3 or separately. If necessary, it is possible to arrange between the chamber 5 and the secondary mill 7 another classifier 8, such as a sieve, so that the overflow 10 of the second classifier 4 is returned back into the feed flow of the chamber 5 for a new microwave radiation treatment in accordance with the invention.

In the FIG. 2 the material 21 to be treated is fed into a grinding mill 22 wherefrom the comminuted material coming out of the mill 22 is discharged into a pin 23. The material from the pin 23 is conveyed into a cyclone 24 for classification. The particle flow as the cyclone underflow 25 of the cyclone 24 is further conveyed into a chamber 26 provided with a microwave source for the frequency of 915 MHz. The chamber 26 is tube-like in shape and the wall of the chamber 26 is made of material transparent to microwave radiation and thus the microwaves are radiated through the wall of the chamber 26. The particle flow 27 treated with microwave radiation is fed into the same grinding mill 22 together with the uncomminuted material 21. Thus the comminution of the primary material 21 and the material 27 radiated by microwaves is carried out in the same primary grinding mill 22.

EXAMPLE

The method of the invention was used in a test work for a sulfidic ore in a slurry form in such a manner that the total energy was kept the same for a sulfidic ore both with the pre-treatment of material having the time of 0.1 s under the influence of microwaves in accordance with the invention and without the pre-treatment of the material. The total energy for comminution was in both cases 44 kWh/t.

As the result from the test work the energy intensity for the pre-treated material was $6\times10^8$ W/m$^3$, while the energy intensity for the material without the pre-treatment was between $10^9$ and $10^{14}$ W/m$^3$, when compared the test material at the same level of breakage. Thus a reduction of at least 50% in the energy intensity for comminution is achieved using the method of the invention.

The invention claimed is:

1. Method of processing ground material, comprising:

a) receiving the ground material, b) separating the ground material into a first fraction having a particle size greater than a predetermined particle size, and a second fraction having a particle size not greater than said predetermined particle size, c) exposing the first fraction of the ground material to an electromagnetic energy treatment, wherein the operation time for the electromagnetic energy is between 0.01 and 1.0 s, and d) grinding the material from the electromagnetic energy treatment step.

2. Method according to claim 1, further comprising:

d) classifying the material from step c) by particle size, e) grinding the fraction of the material from step d) having a particle size greater than a predetermined particle size, and f) exposing the fraction of the material from step d) having a particle size not greater than the predetermined particle size of step e) to an electromagnetic energy treatment.

3. Method according to claim 1, wherein the material received in step a) is mineral slurry having moisture content up to 35%.

4. Method according to claim 1, wherein the electromagnetic energy is microwave.

5. Method according to claim 4, wherein the frequency of the electromagnetic energy is 433 MHz or 896 MHz or 915 MHz or 2.5 GHz.

6. Method according to claim 1, wherein the electromagnetic energy is fed in single mode.

7. Method according to claim 1, wherein the electromagnetic energy is fed in multi mode.

8. Method according to claim 1, wherein the electromagnetic energy is fed in pulsated mode.

9. Method according to claim 1, wherein the operation time for the electromagnetic energy is between 0.05 and 0.5 s.

10. Method of processing ground material, comprising:

a) receiving the ground material, b) classifying the ground material by particle size, c) exposing at least the fraction of the ground material having a particle size greater than a predetermined particle size to an electromagnetic energy treatment, wherein the operation time for the electromagnetic energy is between 0.01 and 1.0 s, d) grinding the material from the electromagnetic energy treatment step, and e) applying steps b) and c) to the ground material from step d).

11. Method according to claim 10, comprising adding the material from step a) to the material from step d), whereby steps b) and c) are applied concurrently to both the material from step a) and the material from step d).

12. Method for processing ore, comprising:

a) grinding the ore, b) separating the ground ore into a first fraction having a particle size greater than a predetermined particle size, and a second fraction having a particle size not greater than said predetermined particle size, c) exposing the first fraction of the ground ore to an electromagnetic energy treatment for a time between 0.01 and 1.0 s, and d) grinding the ore from the electromagnetic energy treatment step.

13. Method according to claim 12, further comprising:

e) applying steps b) and c) to the ground ore from step d).

14. Method according to claim 13, comprising adding the material from step a) to the material from step d), whereby steps b) and c) are applied concurrently to both the material from step a) and the material from step d).

15. Method according to claim 12, wherein step a) comprises:

a1) receiving ore to be ground, a2) adding the ore from step c) to the ore to be ground, and a3) concurrently grinding both the received ore and the ore from step c), and the method comprises applying steps b) and c) to the ground ore from step a3).

16. Method according to claim 12, further comprising:

d) classifying the ground ore from step c) by particle size, e) grinding the fraction of the ore from step d) having a particle size greater than a predetermined particle size, and f) exposing the fraction of the ore from step d) having a particle size not greater than the predetermined particle size of step e) to an electromagnetic energy treatment.

17. Method according to claim 12, wherein the material received in step a) is mineral slurry having moisture content up to 35%.

18. Method according to claim 12, wherein the electromagnetic energy is microwave.

19. Method according to claim 18, wherein the frequency of the electromagnetic energy is 433 MHz or 896 MHz or 915 MHz or 2.5 GHz.

20. Method according to claim 12, wherein the electromagnetic energy is fed in single mode.

21. Method according to claim 12, wherein the electromagnetic energy is fed in multi mode.

22. Method according to claim 12, wherein the electromagnetic energy is fed in pulsated mode.

23. Method according to claim 12, wherein the operation time for the electromagnetic energy is between 0.05 and 0.5 s.

* * * * *